United States Patent [19]

Brand et al.

[11] 4,330,127

[45] May 18, 1982

[54] TOY RACING CAR GAME ACCESSORY

[76] Inventors: Derek A. Brand; Kenneth J. Brand, both of 965 Camino Concordia, Camarillo, Calif. 93010; Derek R. Brand, 126 Ash Ave., Carpinteria, Calif. 93013

[21] Appl. No.: 239,768

[22] Filed: Mar. 2, 1981

[51] Int. Cl.[3] ..... A63F 9/14

[52] U.S. Cl. ..... 273/86 B; 46/1 K; 324/177

[58] Field of Search ..... 273/86 R, 86 B; 46/1 K; 104/60, 295, 296, 304, 305; 324/177; 434/63, 64

[56] References Cited

U.S. PATENT DOCUMENTS

| | | | |
|---|---|---|---|
| 3,390,519 | 7/1968 | Cooper | 273/86 R X |
| 3,432,166 | 3/1969 | Goldfarb | 273/86 B |
| 3,572,711 | 3/1971 | Conklin et al. | 273/86 B |
| 3,594,921 | 7/1971 | Quicker | 434/64 |
| 3,618,397 | 11/1971 | Bosley et al. | 273/86 R X |
| 3,652,937 | 3/1972 | Garrott | 324/177 X |
| 3,936,955 | 2/1976 | Gruen | 434/63 |
| 3,942,114 | 3/1976 | Keeling | 324/177 |
| 4,247,107 | 1/1981 | Smith et al. | 273/86 B |

OTHER PUBLICATIONS

Time Magazine, pp. 64–65, (Mar. 19, 1965).

*Primary Examiner*—Anton O. Oechsle

*Attorney, Agent, or Firm*—Seidel, Gonda, Goldhammer & Panitch

[57] ABSTRACT

A toy racing game accessory comprising a tachometer and fuel gauge. The tachometer includes a rack and pinion assembly which is driven by a linear actuator. A tachometer needle is coupled to the rack and pinion assembly. The action of the linear actuator is proportioned to the amplitude of current passing through the track rails and toy car motor as determined by a speed throttle. The fuel gauge includes a ratchet wheel. The rack and pinion assembly includes a pawl which advances the ratchet wheel if the tachometer needle is made to advance beyond a predetermined threshold speed. The ratchet pawl advances the ratchet wheel so as to cause the fuel gauge needle to advance towards "empty". The amount of advance of the fuel gauge needle depends on the swing of the tachometer. When the fuel gauge reads "empty" a cammed microswitch opens to cut off all power to the track rails and bring the racing car to a halt.

12 Claims, 14 Drawing Figures

FIG. 1
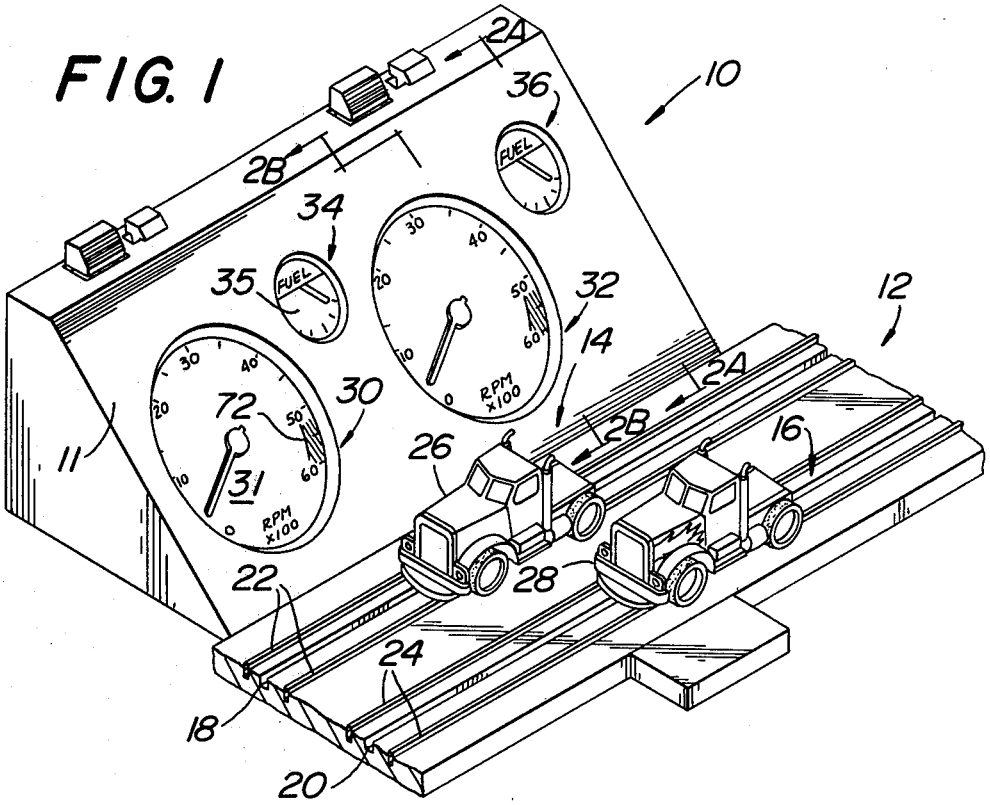
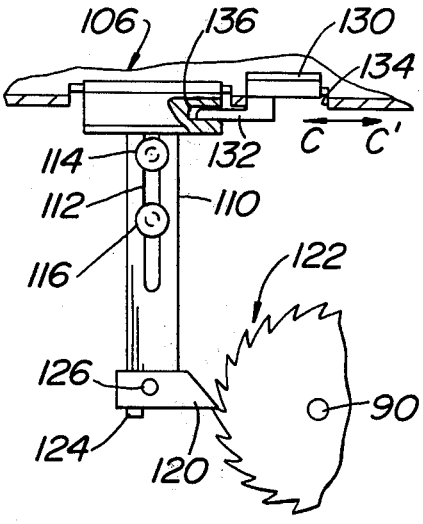
FIG. 11
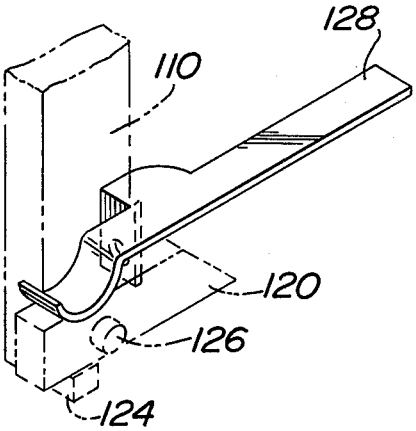
FIG. 12

FIG. 2A
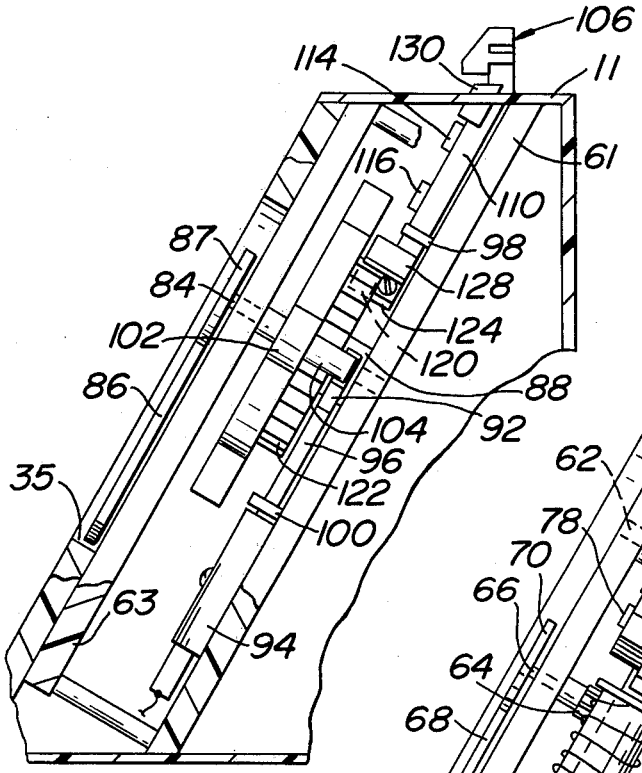
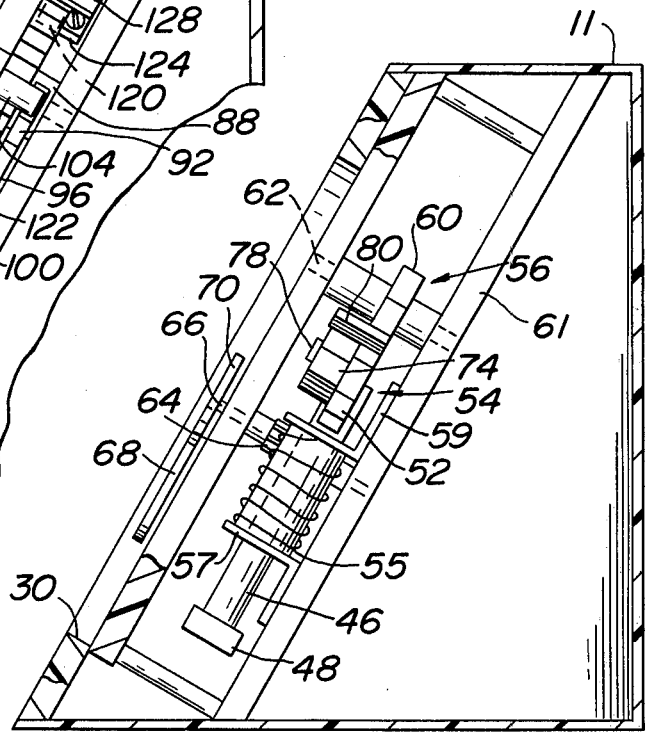
FIG. 2B

FIG. 3
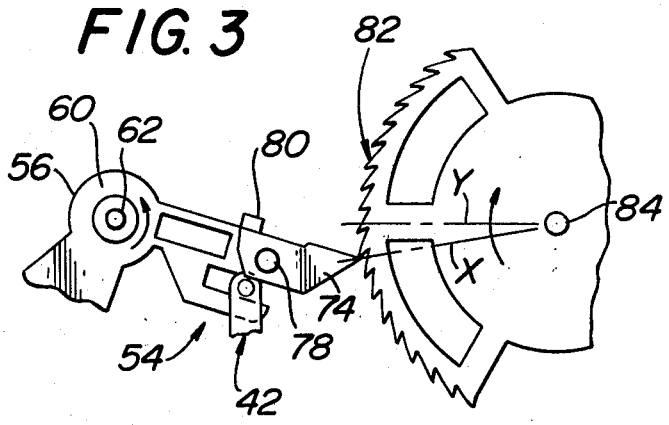
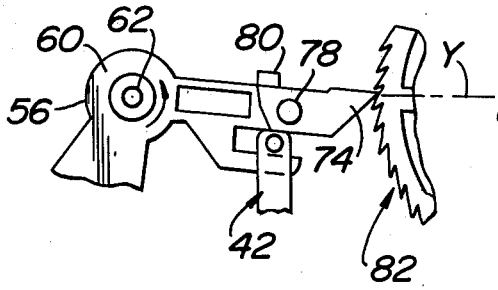
FIG. 4
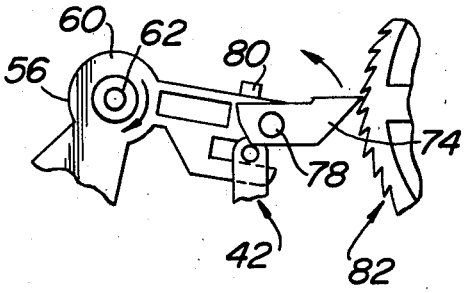
FIG. 5
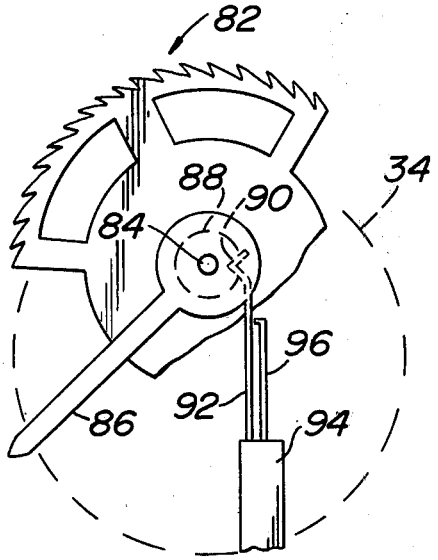
FIG. 6

TOY RACING CAR GAME ACCESSORY

BACKGROUND OF THE INVENTION

The present invention is directed to a toy racing car game accessory and, in particular, to a fuel management system including a tachometer and fuel gauge for an electrically driven toy racing car.

The tachometer provides the thrill of authentic automobile racing by supplying a visible indication of changing car speed based on operation of the speed throttle. The speed throttle may be "opened" to bring the racing car near maximum speed. This is commonly known as "red lining", wherein the tachometer needle advances to a red zone at the extreme of the tachometer dial face. The amount of displacement of the fuel gauge towards "empty" is made to depend on the swing of the tachometer to simulate fuel depletion during a race. "Red lining" of the tachometer needle is accompanied by displacement of the fuel gauge needle towards "empty". During a race, the operator may attempt to bring the car to maximum or near maximum speed whenever possible. If the speed throttle is "opened" and "closed" too much or too often, the fuel gauge is brought quickly to "empty", whereas "opening" and "closing" of the speed throttle only when necessary, for example only at the junction of curves and straightaways, results in more efficient fuel management and gradual movement of the fuel gauge towards "empty".

Accordingly, the accessory provides not only a visible indication of car speed but also an indication of fuel management efficiency based on the skill with which the speed throttle has been operated. If the throttle has not been operated efficiently, for example, by too frequent "red lining", the fuel gauge may quickly swing to "empty". This condition can occur relatively early in a race if the speed throttle is not managed properly. The penalty for this condition is drastic—loss of power to the car during the race.

Throttle controls for electric racing vehicles have been known heretofore. For example, U.S. Pat. No. 3,432,166 discloses a control wherein a ratchet wheel is incremented by a pawl each time that a potentiometer speed control wiper is operated to slow down the car. After a predetermined number of operations of the wiper, a cam arrangement causes the wiper to place the full potentiometer resistance in series with the track rails to drop the track current and slow the car to a crawl. The car must then proceed at a slow pace until it reaches a pit stop for removal from the track.

Various speed indicating devices for toy cars and other apparatus are also known. For example, U.S. Pat. No. 3,652,937 discloses a speed indicator for a model railroad car wherein a circuit connected to the track rails separates commutation modulation from the rectified track current. A capacitor discharges periodically and recharges through a circuit including a meter. The meter reading is proportional to the commutation signal. U.S. Pat. No. 3,594,921 discloses a speedometer which provides an indication of simulated car speed in a driver training apparatus. U.S. Pat. No. 3,942,114 discloses a motor speed indicator wherein a meter is responsive to the sum of sampled throttle voltage and motor current. And U.S. Pat. No. 3,936,955 discloses a stall indicator for a driver training apparatus wherein a tachometer is mechanically coupled to a motor and the motor current is summed with the tachometer signal, the sum being compared to a reference to detect a stall condition.

A device for automatically varying the speed of a toy car based on running time, to simulate change in fuel tank weight, has also been proposed, see "Hobbies" Time Magazine, pages 64–65 (Mar. 19, 1965).

BRIEF SUMMARY OF THE INVENTION

A combined tachometer and fuel gauge for an electrically operated toy racing car game provides a visible indication of the effect of speed throttle manipulation. The tachometer comprises a rack and pinion assembly driven by a linear actuator connected to the speed throttle. The swing of the tachometer is proportioned to the "opening" and "closing" of the speed throttle. The rack and pinion assembly is provided with a pawl for moving an "advance" ratchet wheel which is part of the fuel gauge. The fuel gauge indication depends on the tachometer swing or, more particularly, on the number of times that the speed throttle is "opened" as well as the amount by which the throttle is "opened." Frequent transmissions through the "red line zone" bring the fuel gauge relatively rapidly to an "empty" condition whereas more uniform speed control results in a more gradual movement of the fuel gauge towards "empty". Inefficient operation of the speed throttle results in an early indication of "empty" and complete cut off of power to the car during the race.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is an isometric of the toy racing car game accessory of the present invention mounted alongside a section of racing track.

FIG. 2A is a cross-section taken along lines 2A—2A in FIG. 1 showing the fuel gauge mechanism.

FIG. 2B is a cross-section taken along lines 2B—2B in FIG. 1 showing the tachometer and rack and pinion assembly.

FIG. 3 is a diagram of the movement of the rack and pinion assembly and "advance" ratchet wheel when "red lining".

FIG. 4 is a diagram of the rack and pinion assembly position at top speed.

FIG. 5 is a diagram of the movement of the hinged pawl and "advance" ratchet wheel when the speed throttle is being "closed."

FIG. 6 is a diagram of the cam disc and microswitch.

FIG. 11 is a diagram of the reset button when locked to the reset ratchet wheel.

FIG. 12 is a detail of the reset button leaf spring.

DETAILED DESCRIPTION OF THE INVENTION

Figure 2:
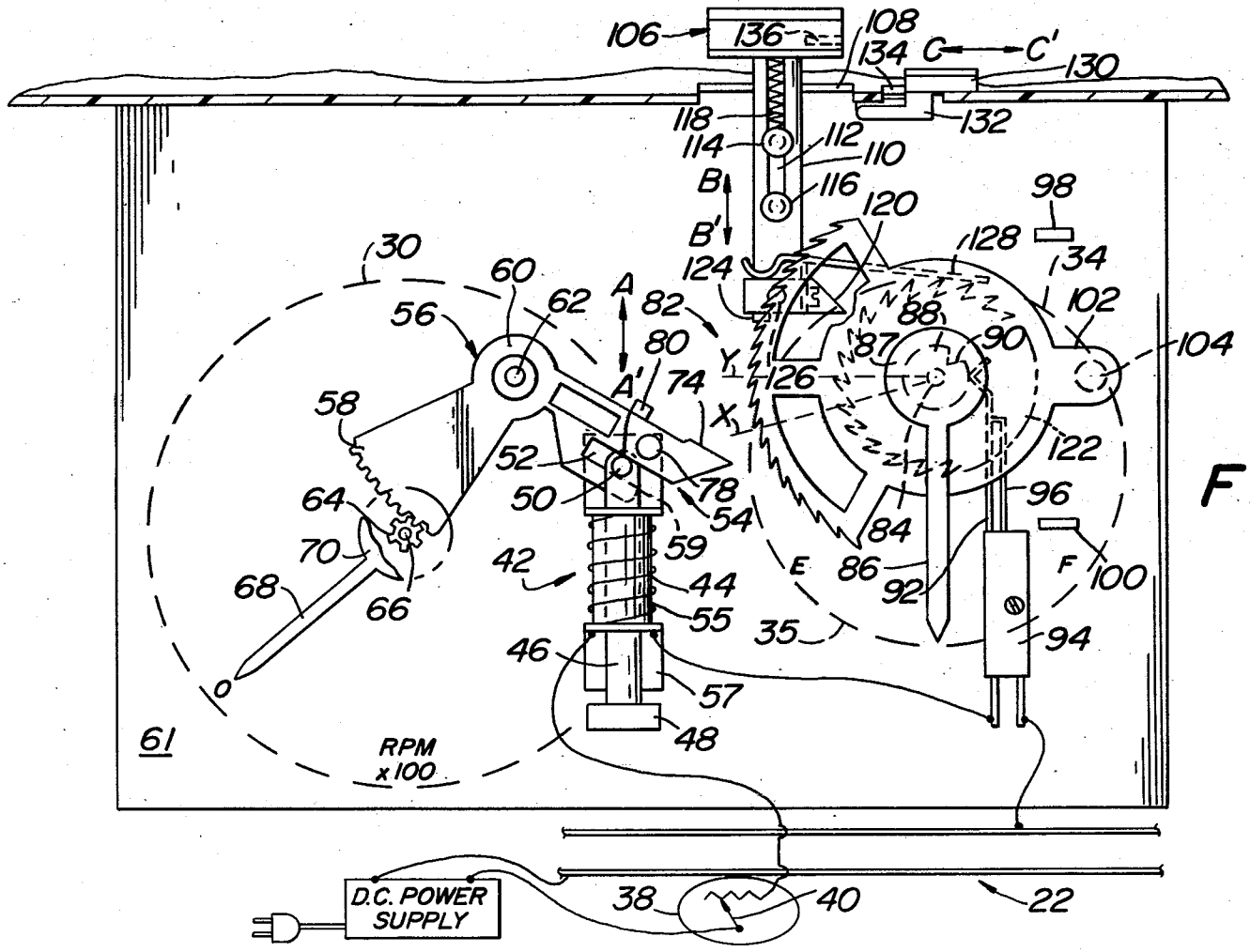
FIG. 2 is a diagrammatic representation of the internal components of the tachometer and fuel gauge for one of the racing tracks, the components of the tachometer and fuel gauge for the other racing track being identical.

Referring to the drawings wherein like numerals indicate like elements, there is shown in FIG. 1 the toy racing car game accessory of the present invention designated generally as 10. The accessory 10 is mounted along side a racing track section 12 comprising two racing lanes 14, 16. Each racing lane includes a slot 18, 20 and a pair of conductive rails 22, 24. An electrically operated toy racing car 26 having a suitable miniature motor travels on the rails 22, and an identical car 28 travels on the rails 24. The car motor derives current from the rails through conventional pick up shoe contacts. The cars travel in a closed circuit along a track loop (not shown) arranged in conventional manner. The rails are powered through a dc power supply and speed throttle (shown in FIG. 2) connected to an outlet as is well known in the art.

The accessory 10 includes a pair of tachometer dials 30, 32 and a pair fuel gauge dials 34, 36 respectively associated with each tachometer dial as shown in FIG. 1. The tachometer and fuel gauge dials 30 and 34 are actuated electrically, as described hereinafter, by the speed throttle associated with one of the rail pairs 22, 24. The tachometer and fuel gauge dials 32, 36 are actuated by an identical speed throttle associated with the other rail pair.

Referring to FIG. 2, the speed throttle 38 is connected at wiper 40 to one of the power supply terminals. The speed throttle 38 is connected in series with a linear actuator 42 comprising a 3 ohm coil 44 and a movable member in the form of a reciprocable slug 46 having a permanent magnet 48 mounted by means of cement or the like at one end. Preferably, the slug 46 is a soft iron material. The permanent magnet 48 is arranged to be drawn upwards in the direction A when the speed throttle is "opened" to increase current to coil 44 and to drop downwardly in the direction A′ when the throttle is "closed" to decrease current to the coil. The slug therefore reciprocates along the central axis of coil 44 as indicated by arrows A—A′ as coil current increases (throttle being "opened") and decreases (throttle being "closed").

A pin 50 secured to the slug 46 protrudes out of the plane of FIG. 2 and rides within a slot 52 in finger 54. The coil 44 is wound on a bobbin 55 secured to flanges 57, 59 which are screwed or otherwise fastened on a rear mounting plate 61. The slug 46 is maintained by gravity in the rest position as shown in FIG. 2 which corresponds to nominal zero coil current and car speed as indicated by the "0" mark on the tachometer dial face 31.

A rack assembly 56 which is a single molded piece comprises a gear segment 58, hub 60, and finger 54. The rack assembly 56 is pivotably mounted on a shaft 62 suitably journaled at one end in the rear mounting plate 61 and at the other end in front mounting plate 63.

The gear segment 58 is an arcuate gear segment which meshes with a six tooth pinion gear 64. Pinion gear 64 is mounted on a shaft 66 suitably journaled at one end in front mounting plate 63 and at the other end in rear mounting plate 61 (FIG. 2A). The tachometer needle 68 is connected to a hub 70 which is mounted on shaft 66 for rotation therewith. The outline of the tachometer dial face 30 is shown in phantom in FIG. 2. A "red line" zone 72 is imprinted or otherwise indicated on the dial face 31 (FIG. 1). The dial face 31 may be paper bearing numerical indicia of car motor speed. The face 31 is affixed to the top surface 33 of plate 63 (FIG. 2A). The plates 61 and 63 are spaced from and secured to each other by screws or the like. Plate 63 is secured by suitable means such as screws to the inside face of the front of the accessory housing 11.

Referring to FIG. 2, the rack assembly 56 and pinion gear 64 comprise a rack and pinion assembly having an action proportional to the "opening" and "closing" of the speed throttle 38. The speed throttle 38 is a variable potentiometer which then "opened" increases current flow to the track rails and car motor by decreasing the potentiometer resistance and which, when "closed", reduces current flow to the track rails by increasing the potentiometer resistance.

Assuming that the speed throttle 38 is being "opened", current increases through the coil 44, displacing the slug 46 upwardly in the direction A. See FIG. 2. The slug pin 50 slidingly contacts finger 54 within slot 52, causing the entire rack assembly 56 to rotate in the counterclockwise direction on shaft 62. As the rack assembly 56 rotates in the counterclockwise direction, the gear segment 58 causes pinion gear 64 to rotate in the clockwise direction on shaft 66. The tachometer needle 68 also rotates in the clockwise direction on shaft 66 to indicate increased car motor speed.

The finger 54 includes a pivotable pawl 74. See FIG. 2. The pawl 74 is pivotably mounted on a pin 78 which is an integral part of the finger 54. The finger 54 is also provided with a stop 80 which extends out of the plane of FIG. 2. The stop 80 extends over the pawl 74 to prevent counter-clockwise rotation of the pawl about pin 78 when the pawl moves upwardly in contact with advance fuel gauge ratchet wheel 82 as described hereafter.

As previously indicated, when the speed throttle 38 is "opened", the rack assembly 56 is rotated counterclockwise by the slug 46 as the slug advances upwardly in the direction A due to the increase in rail current. The pinion gear 64 is rotated in the clockwise direction so that tachometer needle 68 indicates increasing car speed. If the increase in rail current is enough the rack assembly 56 will rotate so that the pawl 74 engages a tooth on the periphery of the advance fuel gauge ratchet wheel 82 lying on the radius X (FIGS. 2 and 3).

Ratchet wheel 82 is mounted on a shaft 84 for rotation therewith. The shaft 84 is suitably journaled at one end in the rear plate 61 and at the other end in plate 63. A fuel gauge needle 86 is connected to a hub 87 which is mounted on shaft 84 for rotation therewith. Pawl 74 therefore rotates the ratchet wheel 82 in the clockwise direction on shaft 84. At the same time, the fuel gauge needle 86 rotates in the clockwise direction, from the "full" reading "F" to the "empty" reading "E" on the fuel gauge dial face 35 indicated in phantom in FIG. 2. The dial face 35 is a paper bearing indicia of fuel tank capacity (FIG. 1). The dial face 35 is affixed to the top surface 33 of plate 63 (FIG. 2A).

Before pawl 74 engages ratchet wheel 82, the rack assembly 56 rotates over a "dead zone" from its initial position to the point of engagement with the ratchet wheel. At the point of engagement, the tachometer needle indicates a preselected or threshold speed. Below that speed, pawl 74 stays in the dead zone and the pawl does not advance the ratchet wheel.

If the speed throttle is "opened" sufficiently, the tachometer needle moves to the preselected or threshold speed and the pawl 74 engages the ratchet wheel 82.

If the speed throttle is "opened" further, the rack assembly 56 rotates and pawl 74 sweeps past the radius X, in engagement with the ratchet wheel 82, thereby advancing the ratchet wheel and fuel gauge needle 86 clockwise. If the speed throttle is then "closed" somewhat, reducing the rail current, the slug 46 descends in the direction A' and the rack assembly 56 rotates clockwise. The pawl 74 slidingly contacts the teeth of the advance ratchet wheel 82, pivoting in the counter-clockwise direction about pivot pin 78. See FIG. 5. The pawl 74 may remain in engagement with the ratchet wheel teeth (above the radius X) or may become disengaged from the ratchet wheel teeth (below radius X), depending on the distance that slug 46 descends which is in turn determined by the amount that the speed throttle is "closed."

While the pawl 74 slides over the teeth of advance ratchet wheel 82, the ratchet wheel remains stationary. Thus, when the speed throttle is "opened", so that the tachometer needle moves past the threshold speed, and is then "closed" to reduce car speed, the advance ratchet wheel will have been displaced clockwise by a rotary increment. As a result, the fuel gauge needle 86 will be displaced clockwise by the same rotary increment towards the empty reading "E". The size of the rotary increment varies, depending on the amount of counterclockwise rotation of the rack assembly 56 past the ratchet wheel radius X (the point at which pawl 74 engages ratchet wheel 82) before the throttle is subsequently "closed."

Successive rotary increments of the fuel guage needle 86 towards "empty" will result from successively "opening" and "closing" the speed throttle. In particular, once the throttle is "opened" so that tachometer needle 68 passes the threshold speed and pawl 74 advances the ratchet wheel 82 by an initial rotary increment, the throttle may then be "closed" and "re-opened" during a race thereby further incrementing the fuel gauge needle towards "empty". It should be appreciated that the amount by which the fuel gauge needle is displaced depends on the amount by which the throttle is "closed" and then "re-opened" as well as the spacing between or total number of ratchet wheel teeth in the sector described by radii X, Y.

Figure 7:
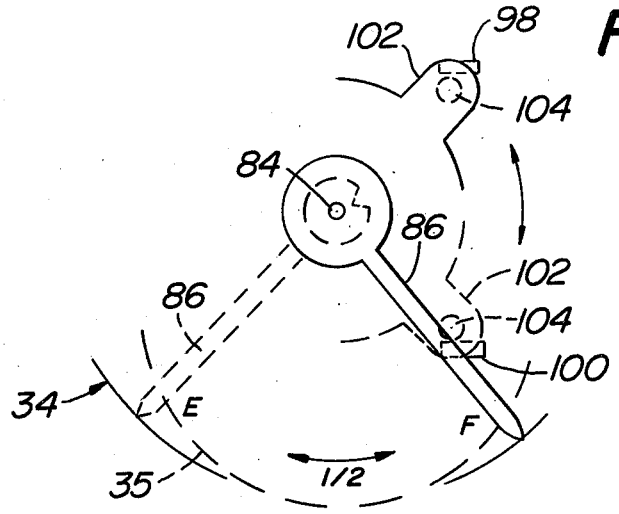
FIG. 7 is a diagram of the movement of the fuel gauge between "empty" and "full" positions.

It can therefore by appreciated that each time the speed throttle 38 is "opened" sufficiently, the pawl 74 advances ratchet wheel 82 in the clockwise direction, and the fuel gauge needle 86 is incremented towards the "empty" reading "E" (FIG. 7). The size of the angular displacement of the ratchet wheel 82, i.e. the amount of advance of needle 86 towards the "empty" reading, depends on the size of successive angular displacements of the pawl 74 in the clockwise (throttle "close") and counter-clockwise (throttle "open") directions.

If the speed throttle is "opened" enough to move the tachometer needle 68 from below the threshold speed to the end of the "red line" zone (corresponding to top speed), the pawl 74 swings up to the radius Y (FIG. 4) which represents the counterclockwise limit of the pawl movement. At this position of the pawl, the magnet 48 strikes the bottom of the bobbin 55 limiting further displacement of the plunger 46 (FIG. 2). The pawl 74 therefore displaces ratchet wheel 82 by the arc separating radii X and Y (FIG. 3) which is the maximum incremental displacement of the ratchet wheel 82 due to an "opening" of the speed throttle. Accordingly, the fuel gauge needle advances by the maximum incremental displacement towards "empty".

Maximum fuel conservation occurs when the speed throttle is "opened" so as to maintain the tachometer needle 68 just below the threshold speed. For this condition, the finger 54 does not advance the ratchet wheel 82 at all since the finger does not advance far enough for pawl 74 to engage the ratchet wheel teeth. Although maximum fuel conservation may be achieved in this manner, racing car speed must be sacrificed drastically.

During a race, the player may wish to increase car speed so that the tachometer needle passes the threshold speed and moves through the "red line" zone to the top speed indication at the end of the zone. This can be done by "opening" the speed throttle fully when the car reaches a straight section of track so that there is maximal current flow to the car motor. If the throttle is then left fully "open" so that the tachometer needle remains at the end of the "red line" zone, the fuel gauge needle cannot be advanced further towards "empty" because the pawl 74 will be locked to a tooth of the ratchet wheel 82 at the radius Y (FIG. 4). Accordingly, the fuel gauge needle is initially advanced by a maximum increment towards "empty", but there is no further indication of fuel consumption while the throttle is held fully "open." The car will travel at high speed. When encountering a curved section of track at this speed, the car may ride off the track. As a practical matter, then, the speed throttle must be "closed" somewhat from the fully "open" setting whenever a curve is encountered. As the speed throttle is "closed", the finger 54 rotates in the clockwise direction and pawl 74 slides over the advance ratchet wheel teeth as previously described. After a curved section of track is negotiated at the reduced speed, the throttle may be "re-opened". As a result, the pawl 74 again advances the ratchet wheel, resulting in a further incremental advance of the fuel gauge needle 86 towards "empty". The size of each successive increment of the fuel gauge needle 86 towards "empty" depends on the amount by which the track current has been varied by "closing" and "re-opening" the throttle.

The most efficient fuel management and racing strategy is to operate the speed throttle to limit the excursions of track current so as to minimize the number and size of the rotary increments of the fuel gauge needle towards "empty" while maintaining high average car speed. This depends on the skill of the operator and entails "opening" the speed throttle to increase the car speed and bring the tachometer needle into the "red line" zone on a straight section of track and "closing" the throttle to reduce the car speed to enable the car to negotiate a curved section of track without riding off the track.

After some variable number of "openings" and "closings" of the speed throttle, depending on the amount that the throttle is "opened" and then "closed" in each instance, the fuel gauge needle will reach the "empty" mark. At this time, all power to the car is cut off by microswitch 94 which is operated by a cam disk 88 (FIG. 2). The cam disk 88 is provided with a detent 90 and is mounted on shaft 84 for rotation therewith. See FIG. 2. When the fuel gauge needle 86 reaches the "empty" position "E", the detent 90 aligns with the bight portion of a contact armature 92 of microswitch 94. The microswitch 94 is connected in series with the coil 44 and one of the track rails 22. Normally, the contact armature 92 rides on the surface of the cam disk 88, causing the armature to engage a stationary contact 96 of the microswitch. This maintains the microswitch in the "closed" position so that current is supplied to the rails 22. When the bight portion of the armature 92 enters detent 90, the armature swings away from the stationary contact 96 thereby "opening" the microswitch 94. As a result, all power is cut off from the rails 22 and the racing car is abruptly halted to simulate an "out of fuel" condition.

A pair of stops 98, 100 (FIG. 2) secured to the rear plate 61 are positioned relative to the ratchet wheel 82 to prevent movement of the fuel gauge needle 86 beyond the "empty" and "full" positions "E", "F" (FIG. 7). The ratchet wheel 82 is provided with an arm 102 (FIG. 2). A roller-shaped lug 104 is secured to or formed as an integral part of the arm 102. When the fuel gauge needle 86 is at the "full" position, the lug 104 contacts stop 98, preventing further counter-clockwise rotation of the ratchet wheel. When the needle 86 is at the "empty" position, the lug 104 contacts the stop 100, preventing further clockwise rotation of the ratchet wheel so that the bight portion of armature 92 remains in the detent 90 thereby maintaining the microswitch "open."

The fuel gauge mechanism may be reset to "full" by repeated depressions of a reset button 106 which depends through an opening 108 in the accessory housing. The reset button includes a shank 110 having a slot 112. The button 106 is mounted on a pair of shafts 114, 116 which are aligned in a plane perpendicular to the plane of FIG. 2. The shafts are secured at their ends to the rear plate 61 to provide a stationary support and alignment structure for the button 106. A compression spring 118 is hooked or otherwise seated at one end on the upper shaft 114 and at the other end to the bottom interior surface of the button crown 107. The spring 118 biases the button upwardly to an inactive position as shown in FIG. 2 wherein a leaf spring 128 frictionally engages the periphery of a reset ratchet wheel as described hereafter.

Figure 8:
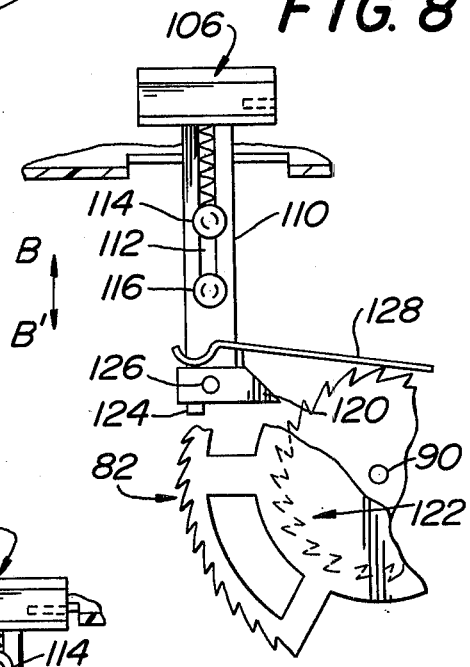
FIGS. 8–10 are diagrams of the movement of the reset button and reset ratchet wheel.

When the button 106 is depressed, shank 110 descends in the direction B′ (FIG. 2), and a pivotable pawl 120 engages a tooth on a reset ratchet wheel 122. The pawl 120 is pivotably mounted on the shank 110 about a pivot pin 126 which is secured to or formed as an integral part of the shank. See FIGS. 8–10. The lower extremity of the shank 110 is provided with a stop 124 which extends outwardly of the plane of FIG. 2 across the lower surface of the pawl 120. The stop 124 is secured to or formed as an integral part of the shank 110 and limits counterclockwise rotation of the pawl 120.

Figure 9:
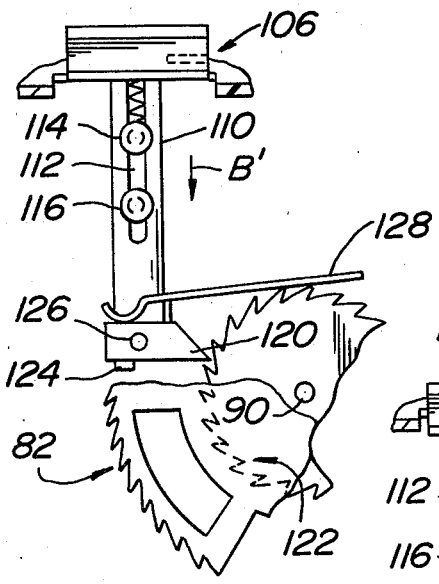
Figure 10:
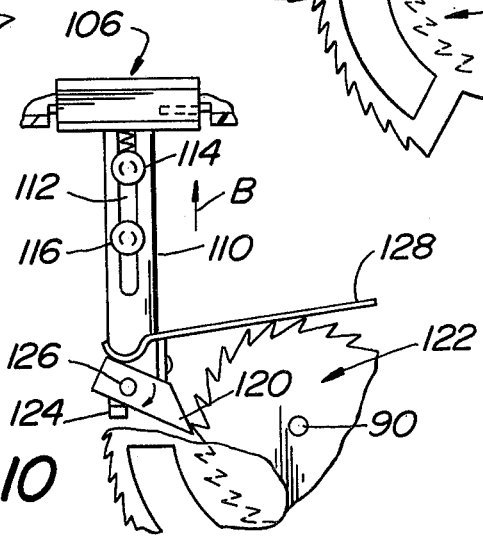

When pawl 120 engages a tooth of the reset ratchet wheel 122 (FIG. 9), it causes the reset ratchet wheel to rotate in the counterclockwise direction, producing like rotation of the fuel gauge needle 86 (FIG. 2). When the button 106 is released or retracted by spring 118 in the direction B (FIG. 2), the pawl 120 rotates clockwise about pin 126 and slides across the teeth of the reset ratchet wheel 122 (FIG. 10). As the pawl 120 slides over the teeth of the reset ratchet wheel 122, the wheel does not rotate.

When the button 106 is depressed in the direction B′, a leaf spring 128 bears against the reset ratchet wheel teeth to prevent the reset ratchet wheel from spinning as it is being reset. The leaf spring 128 also prevents the advance ratchet wheel 82 from spinning as it is being advanced to "empty" (as previously described) by bearing against the reset ratchet wheel teeth when button 106 is at rest. The leaf spring is screw mounted on the shank 110 as shown in FIG. 12. The leaf spring acts as a friction brake, preventing the reset ratchet wheel from being displaced more than a fixed angular increment for each full depression of the button 106. By repeatedly depressing and releasing the button 106, the pawl 120 is caused to contact the teeth of the reset ratchet wheel 122 so as to rotate the reset ratchet wheel in successive increments until the fuel gauge needle 86 returns to the "full" position wherein lug 104 abuts upper stop 98.

If desired, the accessory may be mechanically disabled by means of a defeat switch 130 (FIGS. 2 and 11). The defeat switch 130 is slidably mounted on the accessory housing by suitable elements such as a lateral tongue 132 on the switch body (FIG. 11) and an opening 134 in the housing to permit sliding movement of the switch in the directions C, C′. The switch tongue 132 fits within a lateral channel 136 in the reset button 106. To disable the accessory, the button 106 is depressed so that the pawl 120 engages a tooth on the reset ratchet wheel 122 as shown in FIG. 9. The button 106 is held in this position while the defeat switch is made to slide in the direction C so that the tongue 132 enters the reset button channel 136. The tongue 132 prevents spring 118 from returning the button 106 to its original position. As a result, the pawl 120 remains locked in contact with the reset ratchet wheel 122, preventing rotation of the reset ratchet wheel and the fuel gauge advance ratchet wheel 82. The fuel gauge needle 86 therefore remains at the "full" position despite operation of the speed throttle which may cause the tachometer needle 68 to move between the "0" position and the preselected threshold speed. The speed throttle 38, then, may be operated to a limited degree to regulate the speed of the racing car while the fuel gauge portion of the accessory remains disabled. If the throttle is "opened" while the defeat switch 130 is lodged in channel 136, the tachometer needle 68 is free to move only up to the preselected threshold speed but not past it. Thus, the finger 54 is free to rotate counterclockwise (in response to upward movement of plunger 46) through the dead zone up to the point of contact with advance ratchet wheel 82 (radius X in FIG. 3). This corresponds to the tachometer needle reaching the threshold speed. Any further movement of the finger 54 and tachometer needle will be resisted by the advance ratchet wheel itself which is locked in position by the reset button pawl 120.

If desired, the preselected threshold speed at which advancement of the fuel gauge needle is made possible may be made the same as the speed at which the "red line zone" begins by varying the ratio between gear segment 58 and pinion 64 and by varying the initial position of the pawl 74 relative to the periphery of advance ratchet wheel 82. The point of engagement of the pawl 174 and ratchet wheel 82, radius X (FIG. 2), then, can be made correspond to the position of the tachometer needle at the beginning of the "red line zone". In that case, the fuel gauge needle would only be incremented towards "empty" if the speed throttle were "opened" to cause the tachometer needle to enter the "red line zone."

The present invention may be embodied in other specific forms without departing from the spirit or essential attributes thereof and, accordingly, reference should be made to the appended claims, rather than to the foregoing specification, as indicating the scope of the invention.

We claim:

1. A toy racing car game accessory for use with an electrically powered toy racing car game having a speed throttle for varying the amount of current which flows to two or more track rails from which a toy racing car motor derives power, comprising:

(a) actuating means adapted for movement in response to variations of the current flow to the track rails, said movement depending on the size and direction of said variations in current flow;

(b) displaceable indicating means for indicating racing car motor speed;

(c) means for displacing said means for indicating car motor speed in either of two opposite directions based on the size and direction of said movement of said actuating means;

(d) displaceable indicating means for indicating simulated fuel consumption of the toy racing car; and (e) means for displacing said fuel consumption indicating means in one direction in proportion to the displacement of said means for indicating car motor speed.

2. A toy racing car game accessory according to claim 1 including:

(a) a switch connected in electrical circuit to said actuating means and at least one of said track rails;

(b) means for opening said switch to cut off power to said track rails when said displacement of said fuel consumption indicating means in said one direction exceeds a limit.

3. A toy racing car game accessory according to claim 1 including a reset mechanism for returning said fuel consumption indicating means to an initial position.

4. A toy racing car game accessory according to claim 3 including selectively positionable means for preventing displacement of said fuel consumption indicating means.

5. A toy racing car game accessory for use with an electrically powered toy racing car game having a speed throttle for varying the amount of current which flows to two or more track rails from which a toy racing car motor derives power, comprising:

(a) a linear actuator connected in electrical circuit between said speed throttle and at least one of said track rails;

(b) said linear actuator having a movable member adapted for reciprocable movement in proportion to the amount and direction of change of current flowing through said linear actuator;

(c) a rack assembly mechanically coupled to said movable member, said rack assembly being adapted for reciprocable rotary movement in proportion to said movement of said movable member;

(d) a rotary speed indicating needle operatively associated with said rack assembly for indicating speed of said toy racing car;

(e) a rotary ratchet wheel;

(f) said rack assembly and ratchet wheel being arranged to produce rotary movement of said ratchet wheel in a single direction proportional to the reciprocable movement of said linear actuator movable member;

(g) a fuel consumption indicating needle coupled to said ratchet wheel for rotary movement therewith for indicating simulated fuel consumption of the toy racing car.

6. A toy racing car game accessory according to claim 5 including:

(a) a cam operatively associated with said ratchet wheel for rotary movement therewith;

(b) a switch connected in electrical circuit with said linear actuator and at least one track rail;

(c) said switch having a contact armature displaceable by said cam to open the switch when said ratchet wheel rotary movement exceeds a predetermined limit in said single direction.

7. A toy racing car game accessory according to claim 5 including a reset mechanism for causing said ratchet wheel to rotate so as to return said fuel consumption indicating needle to an initial position.

8. A toy racing car game accessory according to claim 7 including selectively positionable means for preventing displacement of said ratchet wheel to thereby disable said fuel consumption indicating needle.

9. A toy racing car game accessory for use with an electrically powered toy racing car game having a speed throttle for varying the amount of current which flows to two or more track rails from which a toy racing car motor derives power, comprising:

(a) a linear actuator connected in electrical circuit with said speed throttle and at least one of said track rails, (b) said linear actuator having a moveable member adapted for reciprocable displacement in proportion to the amount and direction of change of current flowing through said linear actuator;

(c) a rack assembly mechanically coupled to said moveable member for reciprocable rotary movement in proportion to reciprocable displacement of said movable member;

(d) said rack assembly having a rotatable gear segment and a motive member, said motive member including a pivotable pawl;

(e) a rotary speed indicating needle for indicating speed of said toy racing car motor;

(f) a pinion gear in mesh with said rack assembly gear segment and coupled to said speed indicating needle for producing rotation of said speed indicating needle in either of two directions in response to rotation of said gear segment;

(g) a ratchet wheel adapted to be driven in variable angular increments in a single direction by said motive member pawl; and (h) a rotary fuel consumption indicating needle adapted for rotary movement with said ratchet wheel for indicating simulated fuel consumption of the toy racing car motor based on rotary movement of the ratchet wheel in the single direction.

10. A toy racing car game accessory according to claim 9 including:

(a) a cam operatively associated with said ratchet wheel;

(b) a switch connected in circuit with said linear actuator and at least one track rail;

(c) said switch having a contact armature displaceable by said cam to cause said switch to cut off power to said track rails when the aggregate movement of said ratchet wheel in said single direction exceeds a predetermined limit.

11. A toy racing car game accessory according to claim 9 including:

(a) a spring biased reset button having a shank and a pivotable pawl mounted on said shank;

(b) a reset ratchet wheel mounted for rotary movement with said fuel consumption indicating needle;

(c) said reset ratchet wheel being displaceable in rotary increments by said shank pivotable pawl to return said fuel consumption indicating needle in rotary increments to an initial position.

12. A toy racing car game accessory according to claim 11 including:

(a) a slideable member having a tongue;

(b) said reset button being provided with a channel for receiving said tongue when said shank pivotable pawl contacts said reset ratchet wheel;

(c) whereby said reset ratchet wheel is arrested by said shank pivotable pawl, preventing displacement of said fuel consumption indicating needle.

* * * * *